US009423713B2

(12) United States Patent
Takatsuna

(10) Patent No.: US 9,423,713 B2
(45) Date of Patent: Aug. 23, 2016

(54) POSITIVELY CHARGEABLE ELECTROSTATIC LATENT IMAGE DEVELOPING TONER

(71) Applicant: KYOCERA Document Solutions Inc., Osaka (JP)

(72) Inventor: Toru Takatsuna, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/680,931

(22) Filed: Apr. 7, 2015

(65) Prior Publication Data

US 2015/0293465 A1 Oct. 15, 2015

(30) Foreign Application Priority Data

Apr. 14, 2014 (JP) ..... 2014-083046

(51) Int. Cl.
*G03G 9/08* (2006.01)
*G03G 9/097* (2006.01)

(52) U.S. Cl.
CPC ..... *G03G 9/09716* (2013.01); *G03G 9/09708* (2013.01)

(58) Field of Classification Search
CPC ..... G03G 9/09708; G03G 9/09716
USPC ..... 430/108.6
See application file for complete search history.

(56) References Cited

U.S. PATENT DOCUMENTS

| | | | |
|---|---|---|---|
| 8,394,565 | B2 | 3/2013 | Sensui |
| 2010/0173240 | A1 | 7/2010 | Sensui |

FOREIGN PATENT DOCUMENTS

| | | | |
|---|---|---|---|
| JP | H09-054455 | A | 2/1997 |
| JP | H10-104869 | A | 4/1998 |
| JP | 2012-068497 | A | 4/2012 |
| WO | 2007/114502 | A1 | 10/2007 |

OTHER PUBLICATIONS

An Office Action; Notice of Reasons for Rejection, issued by the Japanese Patent Office on May 24, 2016, which corresponds to Japanese Patent Application No. 2014-083046 and is related to U.S. Appl. No. 14/680,931.

*Primary Examiner* — Mark A Chapman
(74) *Attorney, Agent, or Firm* — Studebaker & Brackett PC

(57) ABSTRACT

A positively chargeable electrostatic latent image developing toner includes a plurality of toner particles each including a toner mother particle and an external additive adhering to a surface of the toner mother particle. The external additive includes metal oxide particles and coat layers that are each disposed over a surface of a corresponding one of the metal oxide particles. The coat layers contain a nitrogen-containing resin. The metal oxide particles contain metal ions having an electronegativity of no greater than 11.

9 Claims, No Drawings

POSITIVELY CHARGEABLE ELECTROSTATIC LATENT IMAGE DEVELOPING TONER

INCORPORATION BY REFERENCE

The present application claims priority under 35 U.S.C. §119 to Japanese Patent Application No. 2014-83046, filed Apr. 14, 2014. The contents of this application are incorporated herein by reference in their entirety.

BACKGROUND

The present disclosure relates to a toner for developing an electrostatic latent image and in particular relates to a positively chargeable toner for developing an electrostatic latent image that includes toner particles including an external additive.

Electrophotography is an example of a technique that uses an electrostatic latent image developing toner in order to form an image. Electrophotography involves irradiating a charged photosensitive drum with light, thereby forming an electrostatic latent image on the surface of the photosensitive drum. The electrostatic latent image is subsequently developed using toner to form a toner image. The toner image that is formed is transferred onto a recording medium. Through the above process, an image is formed on the recording medium.

Electrostatic latent image developing toners are commonly known in which an external additive is caused to adhere to the surface of toner mother particles in order to impart fluidity on the toner, optimize charge of the toner, or improve properties of the toner that facilitate cleaning thereof. The toner mother particles contain a binder resin and internal additives (for example, one or more out of a colorant, a charge control agent, a releasing agent, and a magnetic material). The external additive is commonly made from an inorganic material (for example, silica or titanium oxide).

However, fine particles of an inorganic material, such as silica particles or titanium oxide particles, tend to become negatively charged. In consideration of the above, in a situation in which fine particles of an inorganic material such as described above are to be included in a positively chargeable toner, it has been proposed that positively chargeable polar groups be introduced onto the surface of the inorganic particles. For example, a toner has been proposed in which the external additive has been subjected to surface treatment with an amino group-containing compound. In another example, a toner has been proposed that includes fine particles containing titanium oxide that has been subjected to surface treatment with an alkyl trialkoxysilane and silica that has been subjected to treatment with an ammonium-modified polysiloxane.

SUMMARY

A positively chargeable electrostatic latent image developing toner according to the present disclosure includes a plurality of toner particles each including a toner mother particle and an external additive adhering to a surface of the toner mother particle. The external additive includes metal oxide particles and coat layers that are each disposed over a surface of a corresponding one of the metal oxide particles. The coat layers contain a nitrogen-containing resin. The metal oxide particles contain metal ions having an electronegativity of no greater than 11.

DETAILED DESCRIPTION

The following explains an embodiment of the present disclosure.

A toner according to the present embodiment is an electrostatic latent image developing toner that is positively chargeable. The toner according to the present embodiment is a powder of a large number of particles (referred to below as toner particles). The toner according to the present embodiment can be used in an electrophotographic apparatus (image forming apparatus). The following explains an example of a process of image formation by the electrophotographic apparatus.

First, an electrostatic latent image is formed on a photosensitive member based on image data. Next, the electrostatic latent image that is formed is developed using a developer that contains a toner. In the developing step, charged toner is caused to adhere to the electrostatic latent image such that a toner image is formed on the photosensitive member. After the adhered toner has been transferred onto a transfer belt as a toner image in a subsequent transfer step, the toner image on the transfer belt is transferred onto a recording medium (for example, paper). Next, the toner is fixed to the recording medium by heating the toner. As a result of the above process, an image is formed on the recording medium. A full-color image can for example be formed by superposing toner images of four different colors: black, yellow, magenta, and cyan.

The following explains the composition of the toner (in particular, the toner particles) according to the present embodiment.

The toner particles each include a toner mother particle and an external additive adhering to the surface of the toner mother particle. The toner mother particles contain a binder resin. The toner mother particles may also contain an internal additive (for example, one or more out of a colorant, a releasing agent, a charge control agent, and a magnetic powder). The external additive adheres to the surface of the toner mother particles. The composition of the toner particles is not limited to the composition described above. The toner particles may have been subjected to capsulation. Toner particles that have been subjected to capsulation (i.e., capsule toner particles) each include a binder resin-containing core and a resin layer disposed over the surface of the core (i.e., a shell layer).

The following explains, in order, the toner mother particles (i.e., the binder resin and the internal additives) and the external additive. Non-essential components (for example, the colorant, the releasing agent, the charge control agent, and the magnetic powder) may be omitted in accordance with the intended use of the toner. Note that unless otherwise stated, results (for example, values indicate shapes or properties) of evaluations that are performed on a powder (specifically, toner mother particles, an external additive, or a toner) are number averages of measurements made with respect to an appropriate number of particles. Also, unless otherwise stated, the particle diameter of a powder is the diameter of a representative circle of a primary particle (i.e., the diameter of a circle having the same surface area as a projection of the particle). Note that in the present description the term "-based" may be appended to the name of a chemical compound in order to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof. In the present description the term "(meth) acryl" is used as a generic term for both acryl and methacryl.

<Toner Mother Particles>

[Binder Resin]

The toner mother particles contain a binder resin. The binder resin is preferably a thermoplastic resin. Fixability of the toner can be improved by using a thermoplastic resin as the binder resin. Preferable examples of thermoplastic resins that can be used as the binder resin include styrene-based resins, acrylic acid-based resins, styrene-acrylic acid-based resins, polyethylene-based resins, polypropylene-based resins, vinyl chloride resins, polyester resins, polyamide resins, urethane resins, polyvinyl alcohol-based resins, vinyl ether resins, N-vinyl resins, and styrene-butadiene-based resins. A single type of thermoplastic resin may be used as the binder resin or a combination of two or more types of thermoplastic resin may be used as the binder resin.

A toner in which at least one of a styrene-acrylic acid-based resin and a polyester resin is used as the binder resin has excellent properties in terms of chargeability, colorant dispersibility in the binder resin, and fixability with respect to a recording medium. The following explains the styrene-acrylic acid-based resin and the polyester resin.

The styrene-acrylic acid-based resin is a copolymer of a styrene-based monomer and an acrylic acid-based monomer. Specific examples of the styrene-based monomer include styrene, α-methylstyrene, vinyltoluene, α-chlorostyrene, o-chlorostyrene, m-chlorostyrene, p-chlorostyrene, and p-ethylstyrene. Specific examples of the acrylic acid-based monomer include methyl acrylate, ethyl acrylate, n-propyl acrylate, iso-propyl acrylate, n-butyl acrylate, iso-butyl acrylate, 2-ethylhexyl acrylate, methyl methacrylate, ethyl methacrylate, n-butyl methacrylate, and iso-butyl methacrylate.

The polyester resin can be synthesized through condensation polymerization or condensation copolymerization of a di-, tri-, or higher-hydric alcohol with a di-, tri-, or higher-basic carboxylic acid.

Examples of di-hydric alcohols that can be used in the synthesis of the polyester resin include diols and bisphenols. Examples of preferable diols include ethylene glycol, diethylene glycol, triethylene glycol, propylene glycol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol. Examples of preferable bisphenols include bisphenol A, hydrogenated bisphenol A, polyoxyethylene bisphenol A ether, and polyoxypropylene bisphenol A ether.

Examples of preferable tri- or higher-hydric alcohols that can be used in the synthesis of the polyester resin include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of preferable di-basic carboxylic acids that can be used in the synthesis of the polyester resin include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, succinic acid, alkyl succinic acids (specific examples include n-butylsuccinic acid, isobutylsuccinic acid, n-octylsuccinic acid, n-dodecylsuccinic acid, and isododecylsuccinic acid), and alkenyl succinic acids (specific example include n-butenylsuccinic acid, isobutenylsuccinic acid, n-octenylsuccinic acid, n-dodecenylsuccinic acid, and isododecenylsuccinic acid).

Examples of preferable tri- or higher-basic carboxylic acids that can be used in the synthesis of the polyester resin include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra (methylenecarboxyl)methane, 1,2,7,8-octanetetracarboxylic acid, pyromellitic acid, and EMPOL trimer acid.

Alternatively, an ester-forming derivative (for example, an acid halide, acid anhydride, or lower alkyl ester) of any of the di-, tri-, or higher-basic carboxylic acids listed above may be used. The term "lower alkyl" refers to an alkyl group having from one to six carbon atoms.

The binder resin may be composed entirely of a thermoplastic resin or may include a cross-linking agent (for example, a thermosetting resin) in addition to the thermoplastic resin. By introducing a cross-linking structure into the binder resin, preservability, shape retention, or durability of the toner, or any combination thereof, can be improved while also maintaining excellent fixability of the toner. Preferable examples of thermosetting resins that can be added to the thermoplastic resin include bisphenol A epoxy resins, hydrogenated bisphenol A epoxy resins, novolac epoxy resins, polyalkylene ether epoxy resins, cycloaliphatic epoxy resins, and cyanate resins. A single type of thermosetting resin may be used or a combination of two or more types of thermosetting resin may be used.

The binder resin preferably has a softening point (Tm) of at least 80° C. and no greater than 150° C., and more preferably at least 90° C. and no greater than 140° C. The softening point (Tm) is measured according to the method indicated in the Examples explained further below or according to an alternative thereof.

The binder resin preferably has a glass transition point (Tg) of at least 50° C. and no greater than 65° C., and more preferably at least 50° C. and no greater than 60° C. The glass transition point (Tg) of the binder resin being at least 50° C. and no greater than 65° C. enables improvement of preservability, shape retention, or durability of the toner while also maintaining excellent fixability of the toner. The glass transition point (Tg) is measured according to the method indicated in the Examples explained further below or according to an alternative thereof.

[Colorant]

The toner mother particles may contain a colorant. The colorant can be a pigment or dye that matches the color of the toner. The amount of the colorant is preferably at least 1 part by mass and no greater than 20 parts by mass relative to 100 parts by mass of the binder resin, and more preferably at least 3 parts by mass and no greater than 10 parts by mass.

The toner mother particles may contain a black colorant. An example of the black colorant is carbon black. The black colorant may alternatively be a colorant that has been adjusted to be black in color using a yellow colorant, a magenta colorant, and a cyan colorant.

The toner mother particles may include a non-black colorant such as a yellow colorant, a magenta colorant, or a cyan colorant.

Preferable examples of the yellow colorant include condensed azo compounds, isoindolinone compounds, anthraquinone compounds, azo metal complexes, methine compounds, and arylamide compounds. Specific examples of preferable yellow colorants include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), Naphthol Yellow S, Hansa Yellow G, and C.I. Vat Yellow.

Preferable examples of the magenta colorant include condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Specific examples of preferable magenta colorants include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

Preferable examples of the cyan colorant include copper phthalocyanine compounds, anthraquinone compounds, and basic dye lake compounds. Specific examples of preferable cyan colorants include C.I. Pigment Blue (1, 7, 15, 15:1, 15:2, 15:3, 15:4, 60, 62, and 66), Phthalocyanine Blue, C.I. Vat Blue, and C.I. Acid Blue.

[Releasing Agent]

The toner mother particles may contain a releasing agent. The releasing agent is for example used in order to improve fixability of the toner or resistance of the toner to being offset. In order to improve the fixability or the offset resistance of the toner, the amount of the releasing agent is preferably at least 1 part by mass and no greater than 30 parts by mass relative to 100 parts by mass of the binder resin, and more preferably at least 5 parts by mass and no greater than 20 parts by mass.

Examples of preferable releasing agents include: aliphatic hydrocarbon-based waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon-based waxes such as polyethylene oxide wax and block copolymer of polyethylene oxide wax; plant waxes such as candelilla wax, carnauba wax, Japan wax, jojoba wax, and rice wax; animal waxes such as beeswax, lanolin, and spermaceti; mineral waxes such as ozokerite, ceresin, and petrolatum; waxes having a fatty acid ester as major component such as montanic acid ester wax and castor wax; and waxes in which a part or all of a fatty acid ester has been deoxidized such as deoxidized carnauba wax.

[Charge Control Agent]

The toner mother particles may contain a charge control agent. The charge control agent is for example used in order to improve charge stability, a charge rise characteristic, or durability of the toner. The charge rise characteristic of the toner is an indicator as to whether the toner can be charged to a specific charge level in a short period of time.

Specific examples of positively chargeable charge control agents include: azine compounds such as pyridazine, pyrimidine, pyrazine, 1,2-oxazine, 1,3-oxazine, 1,4-oxazine, 1,2-thiazine, 1,3-thiazine, 1,4-thiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, and quinoxaline; azine compounds (more specifically, direct dyes or the like) such as Azine Fast Red FC, Azine Fast Red 12BK, Azine Violet BO, Azine Brown 3G, Azine Light Brown GR, Azine Dark Green BH/C, Azine Deep Black EW, and Azine Deep Black 3RL; nigrosine compounds (more specifically, acid dyes or the like) such as Nigrosine BK, Nigrosine NB, and Nigrosine Z; metal salts of naphthenic acids and metal salts of higher fatty acids; alkoxylated amines; alkylamides; and quaternary ammonium salts such as benzyldecylhexylmethyl ammonium chloride and decyltrimethyl ammonium chloride. Nigrosine compounds are particularly preferable for achieving rapid charge rise. Two or more of the positively chargeable charge control agents listed above can be used in combination.

A resin having a repeating unit originating from a quaternary ammonium salt, a repeating unit originating from a carboxylic acid salt, a repeating unit having a carboxyl group, or more than one of the above listed repeating units (more specifically, a resin such as a styrene-based resin, an acrylic acid-based resin, a styrene-acrylic acid-based resin, a polyester resin, or the like) can be used as the positively chargeable charge control agent. A styrene-acrylic acid-based resin having a repeating unit originating from a quaternary ammonium salt is particularly preferable in terms of facilitating adjustment of charge of the toner to a desired level. Preferable examples of acrylic acid-based monomers that can be copolymerized with a styrene-based monomer during synthesis of the styrene-acrylic acid-based resin having the repeating unit originating from a quaternary ammonium salt include alkyl (meth)acrylates such as methyl acrylate, ethyl acrylate, n-propyl acrylate, iso-propyl acrylate, n-butyl acrylate, iso-butyl acrylate, 2-ethylhexyl acrylate, methyl methacrylate, ethyl methacrylate, n-butyl methacrylate, and iso-butyl methacrylate. A single type of resin may be used or a combination of two or more types of resin may be used. The molecular weight of the resin may be any suitable value.

Examples of the quaternary ammonium salt include compounds derived from quaternization of a dialkylaminoalkyl (meth)acrylate, a dialkyl (meth)acrylamide, or a dialkylaminoalkyl (meth)acrylamide. Specific examples of the dialkylaminoalkyl (meth)acrylate include dimethylaminoethyl (meth)acrylate, diethylaminoethyl (meth)acrylate, dipropylaminoethyl (meth)acrylate, and dibutylaminoethyl (meth) acrylate. Specific examples of the dialkyl (meth)acrylamide include dimethyl methacrylamide. Specific examples of the dialkylaminoalkyl (meth)acrylamide include dimethylaminopropyl methacrylamide. Also, during synthesis (polymerization) of the styrene-acrylic acid-based resin having the repeating unit originating from the quaternary ammonium salt, a material of the aforementioned quaternary ammonium salt may be used in combination with one or more types of hydroxyl group-containing, polymerizable monomer such as hydroxyethyl (meth)acrylate, hydroxypropyl (meth)acrylate, 2-hydroxybutyl (meth)acrylate, or N-methylol(meth) acrylamide.

<External Additive>

The external additive adheres to the surface of the toner mother particles. The external additive is for example used in order to improve fluidity or handleability of the toner. The amount of the external additive is preferably at least 0.5 parts by mass and no greater than 10 parts by mass relative to 100 parts by mass of the toner mother particles, and more preferably at least 1.5 parts by mass and no greater than 5 parts by mass. The external additive preferably has a particle diameter of at least 0.01 μm and no greater than 1 μm.

In the toner according to the present embodiment, the external additive includes metal oxide particles and coat layers that are each disposed over the surface of a corresponding one of the metal oxide particles. The metal oxide particles are thus covered by the coat layers. In the toner according to the present embodiment, the coat layers contain a nitrogen-containing resin. Inclusion of the nitrogen-containing resin in the coat layers is thought to achieve at least one among effects of: facilitating strong adhesion of the coat layers to the metal oxide particles (first effect); facilitating maintenance of appropriate charge of the external additive (second effect); and facilitating formation of hard coat layers (third effect). Note that the nitrogen-containing resin is a resin that contains nitrogen atoms in the chemical structure thereof.

In order to maintain appropriate charge of the external additive (i.e., in order to inhibit both insufficient and excessive charging), the electronegativity of metal ions contained in the metal oxide particles is preferably no greater than 11, more preferably at least 6 and no greater than 11, and particularly preferably at least 8 and no greater than 10.5. Note that the electronegativity $\chi_i$ of the metal ions contained in the metal oxide particles can be expressed by the equation $\chi_i=\chi(1+2Z)$, wherein $\chi$ represents the electronegativity of the metal of the metal oxide particles in elemental form and Z represents the valence of the metal ions contained in the metal oxide particles. For example, aluminum ions (valence of 3) contained in aluminum oxide particles have an electronegativity of 10.5 ($=1.5\times(1+2\times3)$). In another example, titanium ions (valence of 4) contained in titanium oxide particles have an electronegativity of 13.5 ($=1.5\times(1+2\times4)$). In another example, zinc ions (valence of 2) contained in zinc oxide particles have an electronegativity of 8 ($=1.6\times(1+2\times2)$).

Preferable examples of the metal oxide particles include alumina particles, magnesium oxide particles, and zinc oxide particles. A single type of metal oxide particles may be used or a combination of two or more types of metal oxide particles may be used. Furthermore, the metal oxide particles may be used in combination with other inorganic particles (for example, silica particles), or the metal oxide particles may be used in combination with organic particles.

In order that the external additive maintains appropriate charge, the external additive preferably has a volume resistivity of at least $1.0\times10^8$ Ω·cm and no greater than $1.0\times10^{11}$ Ω·cm. The volume resistivity can be measured according to the method indicated in the Examples explained further below or according to an alternative thereof.

In order that the external additive maintains appropriate charge, the nitrogen-containing resin contained in the coat layers is preferably a thermosetting resin. Also, in order that the external additive maintains appropriate charge, the coat layers more preferably contain, as the nitrogen-containing resin, at least one thermosetting resin selected from a group consisting of an amino resin (specific examples include a melamine-based resin and a urea-based resin), a polyamide resin, a polyimide resin, a polyamide-imide resin, an aniline-based resin, a guanamine-based resin, and a urethane resin, and particularly preferably contain either or both of a melamine-based resin and a urea-based resin. A composition in which the coat layers include either or both of the melamine-based resin and the urea-based resin enables a high degree of adhesion to be maintained between the coat layers and the metal oxide particles over a long period of time.

A melamine resin can be obtained through polycondensation of melamine and formaldehyde. A urea resin can be obtained through polycondensation of urea and formaldehyde. The melamine resin is for example produced according to the process described below.

First an addition reaction of melamine and formaldehyde is carried out. The addition reaction yields a precursor (methylol melamine) of the melamine resin. Next, a condensation reaction (cross-linking reaction) between molecules of methylol melamine is carried out. Through the condensation reaction, amino groups on different methylol melamine molecules bond to one another via methylene groups. The above process yields the melamine resin. The urea resin can be produced according to the same process as described above by using urea instead of melamine.

The nitrogen-containing resin preferably constitutes at least 80% by mass of resin contained in the coat layers, more preferably constitutes at least 90% by mass of resin contained in the coat layers, and particularly preferably constitutes 100% by mass of resin contained in the coat layers.

<Toner Manufacturing Method>

[Toner Mother Particle Preparation]

Examples of preferable processes for preparing the toner mother particles include a pulverization process and an aggregation process.

In one example of the pulverization process, the binder resin, the colorant, the charge control agent, and the releasing agent are first mixed together. Next, the resultant mixture is melt-kneaded using a melt-kneader (for example, a single or twin screw extruder). The resultant melt-knead is subsequently pulverized and classified. The above process yields toner mother particles.

In one example of the aggregation process, fine particles of the binder resin, fine particles of the releasing agent, and fine particles of the colorant are caused to aggregate in an aqueous medium containing the aforementioned fine particles until particles of a desired diameter are obtained. Through the above, aggregated particles of the binder resin, the releasing agent, and the colorant are formed. Next, the aggregated particles are heated in order to cause components contained in the aggregated particles to coalesce. The above process yields toner mother particles having a desired particle diameter.

[External Addition]

Preferable examples of external addition processes include a process that involves mixing the toner mother particles and the external additive using a mixer, such as an FM mixer produced by Nippon Coke & Engineering Co., Ltd. or a Nauta mixer (registered Japanese trademark) produced by Hosokawa Micron Corporation, under conditions that ensure that the external additive does not become embedded in the toner mother particles.

(External Additive Preparation)

The following explains an example (reaction process) of a process for preparing the external additive. In order to efficiently prepare the external additive, a large number of external additive particles are preferably prepared at the same time.

First, a material of the coat layers (for example, a monomer or prepolymer) is added to a liquid dispersion of the metal oxide particles (i.e., a liquid in which the metal oxide particles are present as a disperse phase) that has been pH adjusted. The dispersion is heated while stirring until all of the material of the coat layers in the dispersion has reacted. Next, the dispersion is cooled to room temperature. The above process yields a dispersion of external additive. The external additive includes the metal oxide particles and coat layers that are each disposed over the surface of a corresponding one of the metal oxide particles.

In a situation in which coat layers containing a melamine resin or a urea resin are to be formed, the pH of the dispersion of the metal oxide particles is preferably adjusted to a pH of at least 2 and no greater than 6 prior to formation of the coat layers, and more preferably is adjusted to a pH of at least 3 and no greater than 4. Adjustment of the dispersion to a more acidic pH than neutral (pH 7) can promote formation of the coat layers.

In a situation in which coat layers containing a melamine resin or a urea resin are to be formed, the dispersion of the metal oxide particles preferably has a temperature of at least 60° C. and no greater than 100° C. during formation of the coat layers. Maintaining the temperature of the dispersion as at least 60° C. and no greater than 100° C. can promote formation of the coat layers.

The external additive can be separated from the liquid by performing solid-liquid separation (for example, filtration) on the dispersion. After the external additive has been separated from the liquid, the external additive may for example be washed using water if necessary. The following explains two preferable examples of processes that can be adopted for washing the external additive. The first process involves filtering the dispersion of the external additive, collecting the external additive as a wet cake, and washing the wet cake of the external additive using water. The second process involves causing the external additive to sediment in the liquid, replacing the supernatant of the liquid with water, and redispersing the external additive in the water.

After the washing process, the external additive is preferably dried if necessary.

An example of a preferable process that can be used to dry the external additive involves using a dryer such as a spray dryer, a fluidized bed dryer, a vacuum freeze dryer, or a reduced pressure dryer.

The external additive which is obtained through the preparation process (reaction process) described above may by pulverized in order to micronize the external additive. An example of a preferable process that can be used to pulverize the external additive involves using a pulverizer such as a continuous type surface modifier, a jet mill, or a mechanical pulverizer.

[Two-Component Developer]

The toner according to the present embodiment may be mixed with a carrier to prepare a two-component developer. An example of a preferable process for preparing the two-component developer involves mixing the toner and the carrier using a mixer such as a ball mill.

The carrier used to prepare the two-component developer is preferably a magnetic carrier. An example of a preferable carrier is a carrier in which carrier cores are coated by a resin.

Examples of materials that can be used for the carrier cores include metals such as iron, oxidized iron, reduced iron, magnetite, copper, silicon steel, ferrite, nickel, and cobalt; alloys of any of the aforementioned materials with a metal such as manganese, zinc, or aluminum; iron alloys such as iron-nickel alloy and iron-cobalt alloy; ceramics such as titanium oxide, aluminum oxide, copper oxide, magnesium oxide, lead oxide, zirconium oxide, silicon carbide, magnesium titanate, barium titanate, lithium titanate, lead titanate, lead zirconate, and lithium niobate; and high-dielectric substances such as ammonium dihydrogen phosphate, potassium dihydrogen phosphate, and Rochelle salt. Also, fine particles made substantially from any of the above-listed materials may be dispersed in the resin.

Examples of the resin that coats the carrier cores include acrylic acid-based resins, styrene-based resins, styrene-acrylic acid-based resins, olefin-based resins (specific examples include polyethylene, chlorinated polyethylene, and polypropylene), vinyl chloride resins, polyvinyl acetates, polycarbonates, cellulose resins, polyester resins, unsaturated polyester resins, polyamide resins, urethane resins, epoxy resins, silicone resins, fluororesins (specific examples include polytetrafluoroethylene, polychlorotrifluoroethylene, and polyvinylidene fluoride), phenolic resins, xylene resins, diallyl phthalate resins, polyacetal resin, and amino resins. A single type of resin may be used or a combination of two or more types of resin may be used.

The carrier preferably has a particle diameter of at least 20 μm and no greater than 120 μm, and more preferably at least 25 μm and no greater than 80 μm. The particle diameter of the carrier can be measured using an electron microscope.

The toner preferably constitutes at least 3% by mass and no greater than 20% by mass of the two-component developer, and more preferably least 5% by mass and no greater than 15% by mass of the two-component developer. A composition in which the toner constitutes at least 3% by mass and no greater than 20% by mass of the two-component developer is thought to achieve either or both of an effect of facilitating formation of an image having high image density (first effect) and an effect of making charging failure of the toner unlikely to occur (second effect). By making charging failure of the toner unlikely to occur, the inside of the image forming apparatus can be prevented from becoming soiled by the toner.

Examples

The following explains Examples of the present disclosure. Note that the present disclosure is not limited by the Examples.

Table 1 indicates toners A to F (positively chargeable electrostatic latent image developing toners) according to the Examples of the present disclosure and Comparative Examples.

TABLE 1

| | Toner | External additive |
|---|---|---|
| Example 1 | A | Pa |
| Example 2 | B | Pb |
| Example 3 | C | Pc |
| Comparative Example 1 | D | Pd |
| Comparative Example 2 | E | Pe |
| Comparative Example 3 | F | Pf |

Toners A to F respectively include external additives Pa to Pf indicated in Table 2.

TABLE 2

| External additive | Metal oxide particles Type | Metal oxide particles Electronegativity | Reaction temperature (° C.) | Volume resistivity (Ω · cm) | Coating material |
|---|---|---|---|---|---|
| Pa | a | 10.5 | 65 | 5.00E+10 | Methylol melamine |
| Pb | | | 90 | 3.00E+12 | |
| Pc | b | 8.0 | 90 | 7.00E+08 | |
| Pd | c | 13.5 | 90 | 6.00E+08 | |
| Pe | a | 10.5 | 70 | 3.00E+09 | 3-APTS |
| Pf | | | | 2.00E+09 | Amino modified silicone oil |

The following explains, in order, a preparation method, an evaluation method, and evaluation results for each of toners A to F. Note that unless otherwise stated, results (for example, values indicating shapes or properties) of evaluations that are performed on a powder including a plurality of particles (specifically, toner mother particles, an external additive, or a toner) are number averages of measurements made with respect to an appropriate number of particles. In evaluations in which errors may occur, an evaluation value was calculated by calculating the arithmetic mean of an appropriate number of measured values in order to ensure that any errors were sufficiently small. Also, unless otherwise stated, the particle diameter of a powder is the diameter of a representative circle of a particle (i.e., the diameter of a circle that has the same surface area as a projection of the particle). Values for volume median diameter ($D_{50}$) were measured using a Coulter Counter Multisizer 3 produced by Beckman Coulter, Inc. unless otherwise stated. A measured value for a melting point (Mp) is a temperature of a largest heat absorption peak on a DSC curve plotted using a differential scanning calorimeter (DSC-6220 produced by Seiko Instruments Inc.) unless otherwise stated. Values for number average molecular weight (Mn) and mass average molecular weight (Mw) were measured by gel permeation chromatography unless otherwise stated. Acid values and hydroxyl values were measured in accordance with Japanese Industrial Standard (JIS) K0070-1992 unless otherwise stated. Also, unless otherwise stated, Tg (glass transition point), Tm (softening point), and volume resistivity were measured according to the methods described below.

<Tg Measurement Method>

A heat absorption curve for a sample (for example, a resin) was plotted using a differential scanning calorimeter (DSC-6220 produced by Seiko Instruments Inc.). Next, Tg (glass transition point) of the sample was read from the heat absorption curve. Tg (glass transition point) of the sample corresponds to a point of change in specific heat on the heat absorption curve (i.e., an intersection point of an extrapolation of the base line and an extrapolation of the inclined portion of the curve).

<Tm Measurement Method>

A sample (for example, a resin) was placed in a capillary rheometer (CFT-500D produced by Shimadzu Corporation) and an S-shaped curve (horizontal axis: temperature, vertical axis: stroke) was plotted by causing melt-flow of 1 $cm^3$ of the sample under conditions of a die diameter of 1 mm, a plunger load of 20 $kg/cm^2$, and a heating rate of 6°/minute. Next, Tm (softening point) of the sample was read from the S-shaped curve. Tm (softening point) of the sample is a temperature on the S-shaped curve corresponding to a stroke value of $(S_1+S_2)/2$, where $S_1$ represents a maximum stroke value and $S_2$ represents a base line stroke value at low temperatures.

<Volume Resistivity Measurement Method>

A sample (for example, an external additive) of thickness M (units: cm) was loaded into a cylindrical metal cell. Next, an upper electrode and a lower electrode having an electrode area S (units: $cm^2$) were respectively placed above and below the sample in the cell such as to be in contact with the sample. A load of 686 kPa (7 $kgf/cm^2$) was subsequently applied to the upper electrode. In the state described above, a voltage $V_0$ was applied between the electrodes and the resulting current I (units: A) was used to calculate the volume resistivity (units: Ω·cm) of the sample based on the expression: volume resistivity=$(V_0/I)\times(S/M)$. The contact surface area between the electrodes and the sample was 2.26 $cm^2$ and the voltage $V_0$ was 100 V.

<Preparation Method of Toner A>

[Toner Mother Particle Preparation]

A mixer (FM mixer produced by Nippon Coke & Engineering Co., Ltd.) was used to mix 100 parts by mass of a binder resin, 4 parts by mass of a colorant, 1 part by mass of a charge control agent, and 5 parts by mass of a releasing agent.

The binder resin was a polyester resin having an acid value of 5.6 mg KOH/g, a melting point (Mp) of 120° C., a glass transition point (Tg) of 56° C., a number average molecular weight (Mn) of 1,500, and a mass average molecular weight (Mw) of 45,000. The colorant was C.I. Pigment Blue 15:3 (Copper Phthalocyanine Blue pigment). The charge control agent was a quaternary ammonium salt (BONTRON (registered Japanese trademark) P-51 produced by Orient Chemical Industries, Co., Ltd.). The releasing agent was carnauba wax (Carnauba Wax No. 1 produced by S. Kato & Co.).

Next, the resultant mixture was kneaded using a twin screw extruder (PCM-30 produced by Ikegai Corp.). The kneaded product was subsequently pulverized using a mechanical pulverizer (Turbo Mill produced by Freund-Turbo Corporation). Next, the pulverized product was classified using a classifier (Elbow Jet EJ-LABO produced by Nittetsu Mining Co., Ltd.). The above process yielded toner mother particles (powder) having a volume median diameter ($D_{50}$) of 6.8 μm.

[External Addition]

Next, external addition treatment was performed on the toner mother particles by mixing 100 parts by mass of the toner mother particles with 3.0 parts by mass of external additive Pa using a mixer (FM mixer produced by Nippon Coke & Engineering Co., Ltd.). The mixing caused the external additive Pa to adhere to the surface of the toner mother particles. The above process yielded a large number of toner particles of toner A (powder). External additive Pa used in preparation of toner A was prepared according to the following method.

(External Additive Pa Preparation)

A mixer (T. K. Hivis Disper Mix HM-3D-5 produced by Primix Corporation) was used to stir a mixture of 500 mL of ion exchanged water and 50 g of a-type metal oxide particles at room temperature for 30 minutes with a rotational speed of 30 rpm. The above process yielded a dispersion of solid alumina particles as a disperse phase in an aqueous medium (referred to below as an alumina dispersion). The a-type metal oxide particles were hydrophilic fumed aluminum oxide fine particles (AEROSIL (registered Japanese trademark) Alu130 produced by Nippon Aerosil Co., Ltd.) containing metal ions (aluminum ions with a valence of 3) having an electronegativity of 10.5.

Next, the alumina dispersion was adjusted to a pH of at least 3 and no greater than 4 through addition of 0.5N dilute hydrochloric acid. A coating material (material of the coat layers) of 25 g of water-soluble methylol melamine (Nikaresin (registered Japanese trademark) S-260 produced by Nippon Carbide Industries Co., Inc.) was added to the alumina dispersion that had been adjusted to a pH of at least 3 and no greater than 4. Next, the alumina dispersion was stirred using the mixer at room temperature for five minutes with a rotational speed of 30 rpm. Vessel contents of the mixer were subsequently transferred to a 1 L separable flask that was equipped with a thermometer and a stirring impeller.

Next, the temperature of the flask contents was increased from 35° C. to 65° C. at a rate of 1° C./3 minutes while stirring the flask contents at a rotational speed of 90 rpm. The stirring was performed using a stirring device in which a stirring impeller (As One Stirring Impeller R-1345 produced by As One Corporation) was attached to a motor (As One Tornado Motor 1-5472-04 produced by As One Corporation).

Next, the temperature of the flask contents was maintained at 65° C. (coating material reaction temperature) while stirring the flask contents for 30 minutes at a rotational speed of 90 rpm. Through the above process, coat layers composed substantially of a nitrogen-containing resin (melamine resin) were formed over the surface of the alumina particles. As a result, particles (referred to below as coated particles) were obtained that each included a metal oxide particle (alumina particle) and a coat layer disposed over the surface of the metal oxide particle. Next, the flask contents were cooled to room temperature. As a result, a dispersion of the coated particles was obtained.

Next, vacuum filtration (solid-liquid separation) was performed on the dispersion of the coated particles using a Buchner funnel. A wet cake of the coated particles was obtained through the vacuum filtration. The wet cake of the coated particles was dispersed in 50% by mass concentration aqueous ethanol solution. As a result, a slurry of the coated particles was obtained. Next, the coated particles in the slurry were dried using a continuous type surface modifier (Coatmizer (registered Japanese trademark) produced by Freund Corporation) under conditions of a hot air flow temperature of 45° C. and a flow rate of 2 $m^3$/minute. As a result, a coarse powder of the coated particles was obtained.

Next, the dry coarse powder of the coated particles was finely pulverized using an impact plate jet pulverizer (Jet Mill IJT-2 produced by Nippon Pneumatic Mfg. Co., Ltd.) with a pulverization pressure of 0.6 MPa. External additive Pa (fine powder) was obtained as a result of the above. A ceramic plate was used as the impact plate in the fine pulverization. External additive Pa had a volume resistivity of $5.0\times10^{10}$ Ω·cm.

The following explains preparation methods of toners B to E Note that the evaluation method of toners B to F was the same as the evaluation method of toner A unless otherwise stated.

<Preparation Method of Toner B>

Toner B was prepared according to the same method as toner A in all aspects other than that external additive Pb was used as the external additive instead of external additive Pa. External additive Pb was prepared according to the same method as external additive Pa in all aspects other than that the reaction temperature of the coating material was 90° C. instead of 65° C. External additive Pb had a volume resistivity of $3.0\times10^{12}$ Ω·cm.

<Preparation Method of Toner C>

Toner C was prepared according to the same method as toner A in all aspects other than that external additive Pc was used as the external additive instead of external additive Pa. External additive Pc was prepared according to the same method as external additive Pb in all aspects other than that b-type metal oxide particles were used instead of a-type metal oxide particles. The b-type metal oxide particles were zinc oxide fine particles (MZ-500 produced by Tayca Corporation; average primary particle diameter 25 nm) containing metal ions (zinc ions with a valence of 2) having an electronegativity of 8.0. External additive Pc had a volume resistivity of $7.0\times10^{8}$ Ω·cm.

<Preparation Method of Toner D>

Toner D was prepared according to the same method as toner A in all aspects other than that external additive Pd was used as the external additive instead of external additive Pa. External additive Pd was prepared according to the same method as external additive Pb in all aspects other than that c-type metal oxide particles were used instead of a-type metal oxide particles. The c-type metal oxide particles were titanium oxide fine particles (untreated dry fumed titanium oxide P90 produced by Nippon Aerosil Co., Ltd.) containing metal ions (titanium ions with a valence of 4) having an electronegativity of 13.5. External additive Pd had a volume resistivity of $6.0\times10^{8}$ Ω·cm.

<Preparation Method of Toner E>

Toner E was prepared according to the same method as toner A in all aspects other than that external additive Pe was used as the external additive instead of external additive Pa.

(External Additive Pe Preparation)

First, 500 mL of toluene (1st Grade Toluene produced by Wako Pure Chemical Industries, Ltd.) and 1 g of 3-aminopropyltriethoxysilane (3-APTS) (KBE-903 produced by Shin-Etsu Chemical Co., Ltd.) as the coating material were added into a vessel of a mixer (T. K. Hivis Disper Mix HM-3D-5 produced by Primix Corporation), and the 3-APTS was dissolved in the toluene. Next, 50 g of a-type metal oxide particles were added to the vessel of the mixer and the vessel contents of the mixer were stirred at room temperature for 30 minutes with a rotational speed of 30 rpm. The vessel contents of the mixer were subsequently transferred to a 1 L separable flask that was equipped with a thermometer and a stirring impeller.

Next, the temperature of the flask contents was increased from 35° C. to 70° C. at a rate of 1° C./3 minutes while stirring the flask contents at a rotational speed of 90 rpm. The stirring was performed using a stirring device in which a stirring impeller (As One Stirring Impeller R-1345 produced by As One Corporation) was attached to a motor (As One Tornado Motor 1-5472-04 produced by As One Corporation).

Next, the temperature of the flask contents was maintained at 70° C. while stirring the contents for 30 minutes at a rotational speed of 90 rpm. Toluene was then evaporated from the flask contents using a rotary evaporator and a solid product was removed from the flask contents. Next, the solid product was dried using a reduced pressure dryer set to a temperature of 50° C. and a pressure of 0.1 kPa until the mass of the solid product no longer decreased. The solid product was then heat treated for three hours under nitrogen gas flow using an electric furnace set to a temperature of 200° C. The above process yielded a coarse powder of amino group-containing alumina particles (coated particles). However, a resin was not formed over the surface of the alumina particles.

Next, the dry coarse powder of the coated particles was finely pulverized using an impact plate jet pulverizer (Jet Mill IJT-2 produced by Nippon Pneumatic Mfg. Co., Ltd.) with a pulverization pressure of 0.6 MPa. External additive Pe (fine powder) was obtained as a result of the above. A ceramic plate was used as the impact plate in the fine pulverization. External additive Pe had a volume resistivity of $3.0\times10^{9}$ Ω·cm.

<Preparation Method of Toner F>

Toner F was prepared according to the same method as toner A in all aspects other than that external additive Pf was used as the external additive instead of external additive Pa.

(Preparation of External Additive Pf)

First, 500 mL of n-hexane (1st grade n-hexane produced by Wako Pure Chemical Industries, Ltd.) and 1.0 g of amino modified silicone oil (KF857 produced by Shin-Etsu Chemical Co., Ltd.) as the coating material were added into a vessel of a mixer (T. K. Hivis Disper Mix HM-3D-5 produced by Primix Corporation), and the amino modified silicone oil was dissolved in the n-hexane. Next, 50 g of type-a metal oxide particles were added to the vessel of the mixer and the vessel contents of the mixer were stirred at room temperature for 30 minutes with a rotational speed of 30 rpm. The vessel contents of the mixer were subsequently transferred to a 1 L separable flask that was equipped with a thermometer and a stirring impeller.

Next, the temperature of the flask contents was increased from 35° C. to 70° C. at a rate of 1° C./3 minutes while stirring the contents of the flask at a rotational speed of 90 rpm. The stirring was performed using a stirring device in which a stirring impeller (As One Stirring Impeller R-1345 produced by As One Corporation) was attached to a motor (As One Tornado Motor 1-5472-04 produced by As One Corporation).

Hexane was then evaporated from the flask contents using a rotary evaporator and a solid product was removed from the flask contents. Next, the solid product was dried using a reduced pressure dryer set to a temperature of 70° C. and a pressure of 0.1 kPa until the mass of the solid product no longer decreased. The solid product was then heat treated for three hours under nitrogen gas flow using an electric furnace set to a temperature of 200° C. The above process yielded a coarse powder of amino group-containing alumina particles (coated particles). However, a resin was not formed over the surface of the alumina particles.

Next, the dry coarse powder of the coated particles was finely pulverized using an impact plate jet pulverizer (Jet Mill IJT-2 produced by Nippon Pneumatic Mfg. Co., Ltd.) with a pulverization pressure of 0.6 MPa. External additive Pf (fine powder) was obtained as a result of the above. A ceramic plate was used as the impact plate in the fine pulverization. External additive Pf had a volume resistivity of $2.0\times10^{9}$ acm.

<Evaluation Method>

The following explains an evaluation method used for each of the samples (toners A to F).

[Image Formation]

(Developer Preparation)

A powder mixer (Rocking Mixer (registered Japanese trademark) produced by Aichi Electric Co., Ltd.) was used to mix 100 parts by mass of a developer carrier (carrier for TASKalfa5550ci produced by KYOCERA Document Solutions Inc.) and 12 parts by mass of a sample (toner) for 30 minutes. A two-component developer was produced as a result of the mixing.

(Evaluation Device)

A multifunction peripheral (TASKalfa5550ci produced by KYOCERA Document Solutions Inc.) was used as an evaluation device. The two-component developer that was prepared as explained above was loaded into a developing section of the evaluation device and a sample (toner for replenishment use) was loaded into a toner container of the evaluation device.

(Image Density, Fogging Density, and Charge)

After leaving samples (toner) for 24 hours in three different sets of environmental conditions—normal temperature and humidity (23° C. and 50% RH), high temperature and humidity (32.5° C. and 80% RH), and low temperature and humidity (10° C. and 20% RH)—the evaluation device was used to print a sample image including a solid section on a recording medium (printing paper). Measurements were performed for image density (ID) of the solid section formed on the recording medium, fogging density (FD) of the recording medium, and charge of the sample (toner) contained in the developer.

Next, the evaluation device was used to print a specific evaluation pattern having a coverage of 0.5% on 5,000 recording medium sheets (sheets of printing paper) under each of the three sets of environmental conditions described above. After printing 5,000 sheets, the evaluation device was used to print a sample image including a solid section on a recording medium (printing paper) and measurements were performed for image density (ID) of the solid section formed on the recording medium, fogging density (FD) of the recording medium, and charge of the sample (toner) contained in the developer.

Also, after the evaluation device had been used to print 5,000 sheets under each set of environmental conditions, the evaluation device was used to print a specific evaluation pattern having a coverage of 70% on 1,000 recording medium sheets (sheets of printing paper). After printing 1,000 sheets, the evaluation device was used to print a sample image including a solid section on a recording medium (printing paper) and measurements were performed for image density (ID) of the solid section formed on the recording medium and charge of the sample (toner) contained in the developer. Also, during printing of the 1,000 sheets, fogging density (FD) of the recording medium was measured once in every 25 printed sheets and a largest among the measured values for fogging density (FD) was used as an evaluation value.

Image density (ID) and fogging density (FD) measurements were performed using a reflectance densitometer (RD914 produced by Sakata Inx Eng. Co., Ltd.). Note that fogging density (FD) is a value calculated by subtracting the image density (ID) of a recording medium that has not been subjected to printing from the image density (ID) of a non-image section (white paper section) of the recording medium after being subjected to printing.

Charge measurements were performed using a Q/m meter (MODEL 210HS produced by Trek, Inc.). More specifically, the sample (toner) in 0.10 g (±0.01 g) of the developer was drawn in using a suction section of the Q/m meter and charge was calculated based on the amount of drawn-in sample (toner) and the displayed result (amount of charge) of the Q/m meter.

The evaluation standard for image density (ID) was as follows.

Very good: Image density (ID) of at least 1.4

Good: Image density (ID) of at least 1.3 and less than 1.4

Satisfactory: Image density (ID) of at least 1.2 and less than 1.3

Poor: Image density (ID) of less than 1.2

The evaluation standard for fogging density (FD) was as follows.

Very good: Fogging Density (FD) of no greater than 0.003

Good: Fogging density (FD) of greater than 0.003 and no greater than 0.006

Satisfactory: Fogging density (FD) of greater than 0.006 and no greater than 0.010

Poor: Fogging density (FD) of greater than 0.010

<Evaluation Results>

Tables 3-5 summarize the evaluation results for each of the samples (toners A to F).

TABLE 3

| | Initial (23° C., 50% RH) | | | After printing 5,000 sheets at 0.5% coverage | | | After printing 1,000 sheets at 70% coverage | | |
|---|---|---|---|---|---|---|---|---|---|
| Toner | ID | FD | Charge (μC/g) | ID | FD | Charge (μC/g) | ID | FD (largest) | Charge (μC/g) |
| A | 1.45 Very good | 0.001 Very good | 32 | 1.40 Very good | 0.001 Very good | 35 | 1.45 Very good | 0.003 Very good | 29 |
| B | 1.43 Very good | 0.001 Very good | 36 | 1.38 Good | 0.001 Very good | 40 | 1.43 Very good | 0.002 Very good | 33 |
| C | 1.46 Very good | 0.001 Very good | 34 | 1.41 Very good | 0.001 Very good | 35 | 1.43 Very good | 0.002 Very good | 30 |
| D | 1.46 Very good | 0.001 Very good | 30 | 1.42 Very good | 0.001 Very good | 34 | 1.46 Very good | 0.008 Satisfactory | 25 |
| E | 1.44 Very good | 0.001 Very good | 34 | 1.40 Very good | 0.001 Very good | 35 | 1.43 Very good | 0.023 Poor | 22 |
| F | 1.44 Very good | 0.001 Very good | 33 | 1.41 Very good | 0.001 Very good | 37 | 1.42 Very good | 0.026 Poor | 21 |

TABLE 4

| | Initial (32.5° C., 80% RH) | | | After printing 5,000 sheets at 0.5% coverage | | | After printing 1,000 sheets at 70% coverage | | |
|---|---|---|---|---|---|---|---|---|---|
| Toner | ID | FD | Charge (μC/g) | ID | FD | Charge (μC/g) | ID | FD (largest) | Charge (μC/g) |
| A | 1.48 Very good | 0.002 Very good | 25 | 1.41 Very good | 0.001 Very good | 26 | 1.42 Very good | 0.004 Good | 20 |
| B | 1.45 Very good | 0.002 Very good | 24 | 1.40 Very good | 0.001 Very good | 28 | 1.42 Very good | 0.004 Good | 21 |
| C | 1.49 Very good | 0.002 Very good | 24 | 1.42 Very good | 0.001 Very good | 27 | 1.43 Very good | 0.003 Very good | 19 |
| D | 1.46 Very good | 0.003 Very good | 23 | 1.43 Very good | 0.001 Very good | 25 | 1.43 Very good | 0.016 Poor | 16 |
| E | 1.48 Very good | 0.002 Very good | 25 | 1.42 Very good | 0.001 Very good | 27 | 1.40 Very good | 0.035 Poor | 14 |
| F | 1.50 Very good | 0.002 Very good | 26 | 1.42 Very good | 0.001 Very good | 27 | 1.40 Very good | 0.040 Poor | 13 |

TABLE 5

| | Initial (10° C., 20% RH) | | | After printing 5,000 sheets at 0.5% coverage | | | After printing 1,000 sheets at 70% coverage | | |
|---|---|---|---|---|---|---|---|---|---|
| Toner | ID | FD | Charge (μC/g) | ID | FD | Charge (μC/g) | ID | FD (Largest) | Charge (μC/g) |
| A | 1.40 Very good | 0.001 Very good | 40 | 1.35 Good | 0.001 Very good | 43 | 1.41 Very good | 0.003 Very good | 38 |
| B | 1.39 Good | 0.001 Very good | 43 | 1.28 Satisfactory | 0.001 Very good | 48 | 1.37 Good | 0.003 Very good | 41 |

TABLE 5-continued

| | Initial (10° C., 20% RH) | | | After printing 5,000 sheets at 0.5% coverage | | | After printing 1,000 sheets at 70% coverage | | |
|---|---|---|---|---|---|---|---|---|---|
| Toner | ID | FD | Charge (μC/g) | ID | FD | Charge (μC/g) | ID | FD (Largest) | Charge (μC/g) |
| C | 1.40 Very good | 0.001 Very good | 39 | 1.37 Good | 0.001 Very good | 42 | 1.41 Very good | 0.003 Very good | 36 |
| D | 1.41 Very good | 0.001 Very good | 39 | 1.36 Good | 0.001 Very good | 42 | 1.42 Very good | 0.009 Satisfactory | 30 |
| E | 1.42 Very good | 0.001 Very good | 41 | 1.35 Good | 0.001 Very good | 43 | 1.40 Very good | 0.034 Poor | 39 |
| F | 1.42 Very good | 0.001 Very good | 41 | 1.35 Good | 0.001 Very good | 44 | 1.40 Very good | 0.035 Poor | 38 |

In each of toners A, B, and C (positively chargeable electrostatic latent image developing toners according to Examples 1-3), the external additive includes metal oxide particles and coat layers that are each disposed over the surface of a corresponding one of the metal oxide particles. The coat layers contain a nitrogen-containing resin. The metal oxide particles contain metal ions having an electronegativity of no greater than 11. As shown in Tables 3-5, each of the positively chargeable electrostatic latent image developing toners having the above configuration achieved an image density (ID) of at least 1.28 and a fogging density (FD) of no greater than 0.004 regardless of whether used in normal temperature and humidity environmental conditions, high temperature and humidity environmental conditions, or low temperature and humidity environmental conditions. The positively chargeable electrostatic latent image developing toners according to Examples 1-3 had a low tendency to suffer from reduced charge or produce a fogged image even when images were printed with a high image density straight after printing images with a low image density for a long period of time. Also, the aforementioned toners exhibited little variation in charge in response to variation in environmental conditions.

In each of toners A and C (positively chargeable electrostatic latent image developing toners according to Examples 1 and 3), the external additive had a volume resistivity of at least $1.0\times10^{8}$ Ω·cm and no greater than $1.0\times10^{11}$ Ω·cm. Each of the positively chargeable electrostatic latent image developing toners having the above configuration achieved an image density (ID) of at least 1.35 and a fogging density (FD) of no greater than 0.004 regardless of whether used in normal temperature and humidity environmental conditions, high temperature and humidity environmental conditions, or low temperature and humidity environmental conditions.

In a toner including a plurality of different types of external additive adhering to toner mother particles, it is thought that chargeability of the toner can be improved as a result of at least one of the external additives having the configuration described above.

What is claimed is:

1. A positively chargeable electrostatic latent image developing toner comprising a plurality of toner particles each including:

a toner mother particle; and an external additive adhering to a surface of the toner mother particle, wherein the external additive includes metal oxide particles and coat layers each disposed over a surface of a corresponding one of the metal oxide particles, the coat layers contain a nitrogen-containing resin, and the metal oxide particles contain metal ions having an electronegativity of no greater than 11.

2. The positively chargeable electrostatic latent image developing toner according to claim 1, wherein the external additive has a volume resistivity of at least $1.0\times10^{8}$ Ω·cm and no greater than $1.0\times10^{11}$ Ω·cm.

3. The positively chargeable electrostatic latent image developing toner according to claim 1, wherein the coat layers contain a thermosetting resin as the nitrogen-containing resin.

4. The positively chargeable electrostatic latent image developing toner according to claim 3, wherein the coat layers contain, as the nitrogen-containing resin, one or more thermosetting resins selected from a group consisting of an amino resin, a polyamide resin, a polyimide resin, a polyamide-imide resin, an aniline-based resin, a guanamine-based resin, and a urethane resin.

5. The positively chargeable electrostatic latent image developing toner according to claim 4, wherein the coat layers contain a melamine-based resin as the nitrogen-containing resin.

6. The positively chargeable electrostatic latent image developing toner according to claim 4, wherein the coat layers contain a urea-based resin as the nitrogen-containing resin.

7. The positively chargeable electrostatic latent image developing toner according to claim 1, wherein the electronegativity of the metal ions contained in the metal oxide particles is at least 6 and no greater than 11.

8. The positively chargeable electrostatic latent image developing toner according to claim 1, wherein the metal oxide particles are aluminum oxide particles.

9. The positively chargeable electrostatic latent image developing toner according to claim 1, wherein the metal oxide particles are zinc oxide particles.

* * * * *